US009198544B1

(12) United States Patent
Duddie

(10) Patent No.: US 9,198,544 B1
(45) Date of Patent: Dec. 1, 2015

(54) TOWEL RACK WITH ACTUATING RETAINER BAR

(71) Applicant: Jason Duddie, Bogota, NJ (US)

(72) Inventor: Jason Duddie, Bogota, NJ (US)

( * ) Notice: Subject to any disclaimer, the term of this patent is extended or adjusted under 35 U.S.C. 154(b) by 0 days.

(21) Appl. No.: 13/888,432

(22) Filed: May 7, 2013

(51) Int. Cl.

| | |
|---|---|
| ***A47F 5/08*** | (2006.01) |
| ***A47F 7/00*** | (2006.01) |
| ***A47H 13/00*** | (2006.01) |
| ***A47K 10/04*** | (2006.01) |

(52) U.S. Cl.
CPC ..... *A47K 10/04* (2013.01)

(58) Field of Classification Search
CPC ..... A47K 10/04; A47K 10/10; E05B 69/00
USPC ..... 211/16, 6, 7, 88.04, 105.1, 105.2, 211/105.3, 105.4, 105.5, 105.6, 123; 248/200.1, 201, 214, 299.1, 222.51; 16/438, 444
See application file for complete search history.

(56) References Cited

U.S. PATENT DOCUMENTS

| | | | | | |
|---|---|---|---|---|---|
| 261,817 | A | * | 7/1882 | Anderson | 211/16 |
| 320,211 | A | * | 6/1885 | Bergsten | 211/16 |
| 531,496 | A | * | 12/1894 | Mallory | 281/19.1 |
| 1,059,065 | A | * | 4/1913 | Oster | 211/7 |
| 1,147,019 | A | * | 7/1915 | Henry | 211/7 |
| 1,147,167 | A | * | 7/1915 | Herrman | 211/7 |
| 1,196,484 | A | * | 8/1916 | Russell | 211/7 |
| 1,197,960 | A | * | 9/1916 | Sermon | 211/7 |
| 1,228,636 | A | | 6/1917 | Bangs | |
| 1,232,214 | A | | 8/1917 | Bye | |
| 1,276,073 | A | * | 8/1918 | Jenkins | 248/223.31 |
| 1,342,274 | A | * | 6/1920 | Clark | 211/7 |
| 1,355,604 | A | * | 10/1920 | Hubert | 211/7 |
| 1,480,065 | A | | 1/1924 | Hart et al. | |
| 1,800,030 | A | * | 4/1931 | Reynolds | 211/123 |
| 2,030,498 | A | | 2/1936 | Chmurski | |
| 2,259,166 | A | * | 10/1941 | Kendrick | 211/123 |
| 2,492,607 | A | | 12/1949 | Whitney | |
| 2,606,667 | A | * | 8/1952 | Hornick | 211/124 |
| 2,642,193 | A | | 6/1953 | Severin | |
| 2,645,351 | A | * | 7/1953 | London | 211/7 |
| 2,672,240 | A | | 3/1954 | Conley, Jr. | |
| 2,834,477 | A | | 5/1958 | Schmuck | |
| 2,929,513 | A | * | 3/1960 | Herzberg | 211/88.04 |
| 2,978,197 | A | * | 4/1961 | Anderson | 242/596.5 |
| 3,118,542 | A | | 1/1964 | Lewis | |
| 3,128,024 | A | * | 4/1964 | Downham | 225/43 |
| 3,374,899 | A | * | 3/1968 | Bator | 211/96 |
| 3,805,963 | A | | 4/1974 | Klein | |
| 3,871,526 | A | | 3/1975 | Marsack | |

(Continued)

FOREIGN PATENT DOCUMENTS

| | | | | |
|---|---|---|---|---|
| GB | 2313105 | A | * 11/1997 | A47K 10/38 |

*Primary Examiner* — Daniel J Troy
*Assistant Examiner* — Kimberly S Wright
(74) *Attorney, Agent, or Firm* — Invention To Patent Serices; Alex Hobson

(57) ABSTRACT

A towel rack having an actuating retainer bar is described. The retainer bar is configured to actuate down to secure a towel draped over the towel bar. A locking feature retains the retainer bar in a dosed position and can be released by a release device in some configurations. A spring configured in an actuator to pull the retainer bar up and away from the towel bar, thereby allowing a user to remove a towel or other article. In an alternative configuration, the towel rack has an engagement bracket that allows for the positioning of the retainer bar along a slot. The retainer bar may be manually manipulated along the slot and locked into position by a plurality of teeth.

5 Claims, 11 Drawing Sheets

(56) References Cited

U.S. PATENT DOCUMENTS

| | | | | |
|---|---|---|---|---|
| 4,729,482 | A | 3/1988 | Nicholson | |
| 4,997,223 | A * | 3/1991 | Croft | 297/367 R |
| 5,373,950 | A | 12/1994 | Marc | |
| 5,447,244 | A | 9/1995 | Mentzer | |
| 5,779,313 | A * | 7/1998 | Rohee | 297/367 R |
| 6,845,870 | B2 | 1/2005 | Yang | |
| 2008/0000859 | A1 | 1/2008 | Yang et al. | |
| 2008/0121598 | A1 * | 5/2008 | Brinson | 211/88.04 |

* cited by examiner

TOWEL RACK WITH ACTUATING RETAINER BAR

BACKGROUND OF THE INVENTION

1. Field of the Invention

The present invention relates to towel rack and particularly a towel rack having a spring actuated retainer bar.

2. Background

Most conventional towel racks comprise a single towel bar for draping a towel. Often times, the towel will slip and fall off the single towel bar and end up on the floor. Some towel bars having means to retain the towel have been described, however, they are cumbersome and do not provide for an automatic lifting means. There is a need for a towel rack having a towel retainer that can be easily actuated and will stay open to facilitate insertion of a towel.

SUMMARY OF THE INVENTION

The invention is directed to a towel rack having an actuating retainer bar. An exemplary actuating towel rack, as described herein, comprises a towel bar, a retainer bar, an actuator and a release device wherein the retainer bar is pivotally configured over the towel bar for the purpose of retaining a towel draped over the towel bar. The actuator may be spring loaded to pivot the retainer bar up and away from the towel bar when the release device is engaged. A towel bar, as described herein, has an elongated towel portion coupled with first and second bar extensions that retain the elongated towel portion at some distance from a mounting surface wherein the elongated towel portion is configured to extend substantial parallel with said mounting surface. A retainer bar, as described herein, has an elongated retainer portion coupled with a first and second retainer extensions that retain the elongated retainer portion at some distance from a mounting surface wherein the elongated retainer portion is configured to extend substantial parallel with said mounting surface and substantially parallel with and over the elongated towel portion of the towel bar. The towel and retainer bar may comprise a single one-piece bar that is bent on the ends as shown and described herein.

An actuator, as described herein, is a spring loaded device that is coupled to the retainer bar and lifts the retainer bar up and away from the towel bar to allow a user to remove a towel retained between the towel bar and the retainer bar. An actuator may comprise at least one spring device attached to at least one retainer extension. In an exemplary embodiment, an actuator is attached to both retainer extensions. An actuator may be coupled with a mounting plate and be configured between a mounting plate and a retainer bar extension.

A towel rack, as described herein, comprises a locking feature that retains the retainer bar in a specific position, such as in a closed position with the towel bar. In an exemplary embodiment, a locking feature comprises a hook that extends from the retainer bar and engages with the towel bar when the towel bar is pressed down into an engaged position with the towel bar. It is to be understood that a hook may be configured on the towel bar and engage with the retainer bar as well. A hook may be configured to flex around a bar or bar extension, whereby the hook locks into position to hold the two bars in position relative to each other. A release device may be activated to actuate the hook away from the locked position to allow the retainer bar to lift up and away from the towel bar.

In another embodiment, a locking feature comprises a latch that engages with a latch retainer for example. A latch may extend from the retainer bar and may engage with a latch retainer configured on the towel bar when the retainer bar is pushed down. A latch and/or latch retainer may comprise a spring positional element that allows the latch to engage with the latch retainer when towels of various thicknesses are inserted into the towel rack. A spring positional element may be configured on the latch and/or the latch retainer.

In still another embodiment, a towel rack comprises an engagement bracket type locking feature whereby the retainer bar may be locked in a plurality of positional locations as it is moved down into an engaged position with the towel bar. An engagement bracket comprises a plurality of teeth configured to retain an engagement feature coupled to the retainer bar, such as an extended portion. An engagement bracket further comprises a slot that is configured for the insertion of a post coupled to the retainer bar. The slot defines generally the motion of a retainer end, whereby the end of the retainer extension moves along the path defined by the slot. The retainer bracket further comprises a spring coupled to the retainer bar, whereby the spring is extended as the retainer bar is moved down into an engaged position with the towel bar. The retainer bar may be moved down into an engaged position by pushing down on the retainer bar, whereby the retainer extension end moves along the patch defined by the slot. The engagement feature of the retainer bar moves past a plurality of teeth until the retainer bar is locked into position with a tooth. The weight of the retainer bar keeps the engagement feature locked with a tooth in a closed position. When the user wants to lift the retainer bar to remove a towel, the user simply has to pull the retainer bar out, or in a direction perpendicular to the length direction of the elongated retainer portion. Pulling the retainer bar out, releases the engagement feature from being locked with a tooth on the engagement bracket and the spring then pulls the retainer bar up along the slot. The user my simple release the retainer bar in any position, whereby the bar pivots down and engages with a tooth to be locked in a position.

A release device, as described herein, releases the retainer bar from a locked position, whereby the actuator then lifts the retainer bar. For example, a retainer bar may be in an engaged position, whereby it is clamped down on a towel configured between the retainer bar and the towel bar, whereby a release device, such as a release button, may be pressed to release the retainer bar from this position and the spring loaded actuator may automatically lift the retainer bar up and away from the towel bar. A user may then remove the towel. A release button may be configured in any suitable location, including on the retainer bar or retainer bar extensions, on the actuator or on a mounting plate, for example. It is to be understood that a release device may be any type of actuating device that releases the locking mechanism and includes a button, sliding device, toggle switch, lever, handle, knob and the like. An engagement bracket type locking feature provides for ease of use whereby the use can quickly and easily position the retainer bar in a desired location.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention

DETAILED DESCRIPTION OF THE ILLUSTRATED EMBODIMENTS

Figure 1:
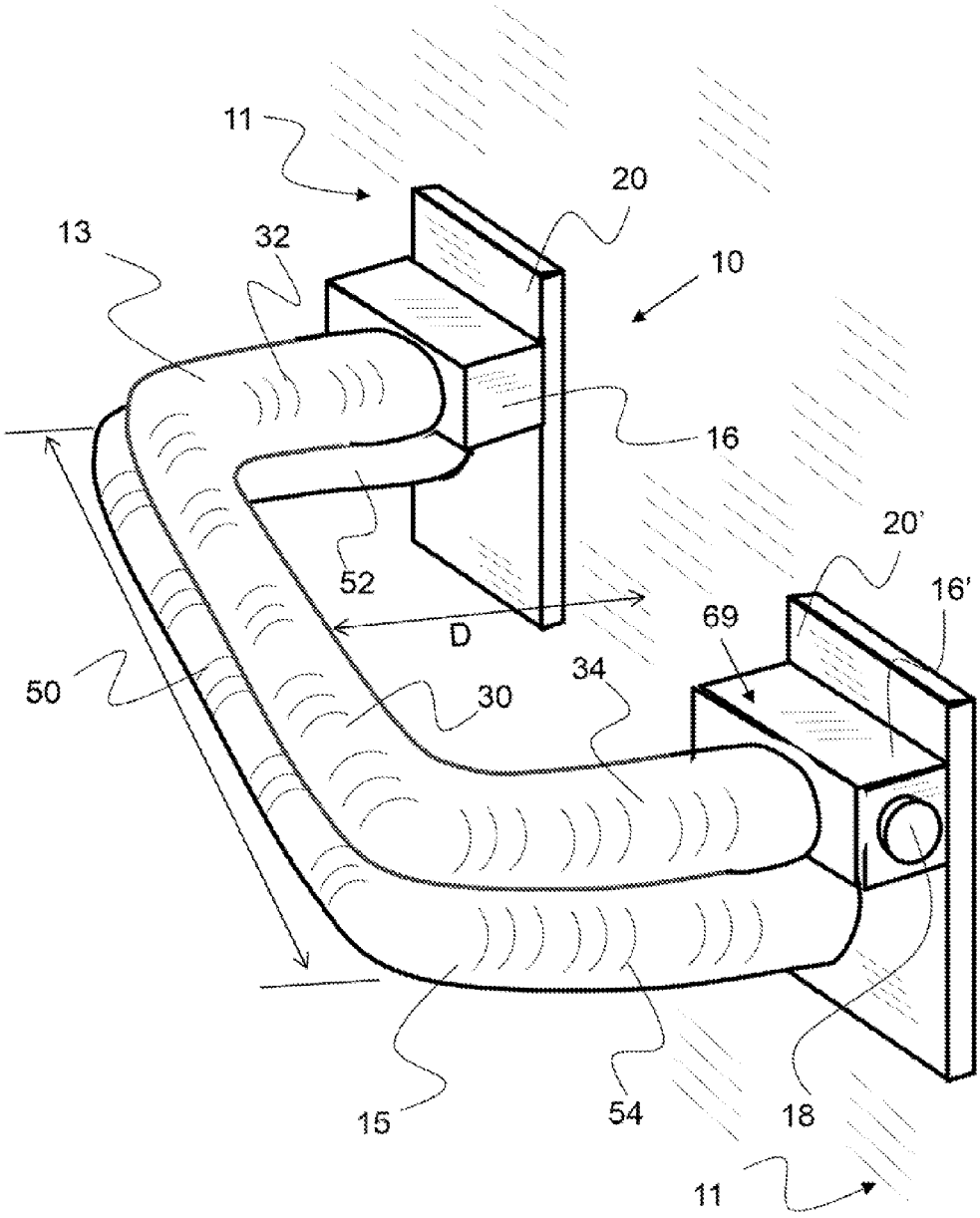

FIG. 1 shows an isometric view of an exemplary towel rack having a towel bar and a retainer bar in a dosed position with the towel bar.

Figure 2A:
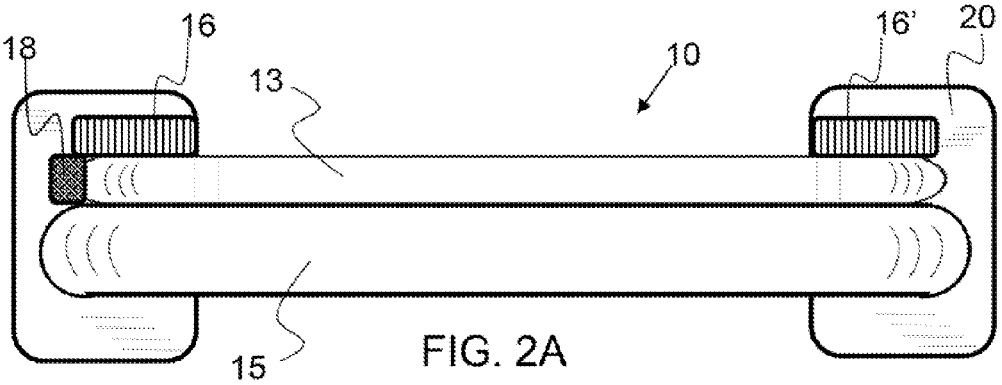

FIG. 2A shows a front view of an exemplary towel rack having a towel bar and a retainer bar in a dosed position.

Figure 2B:
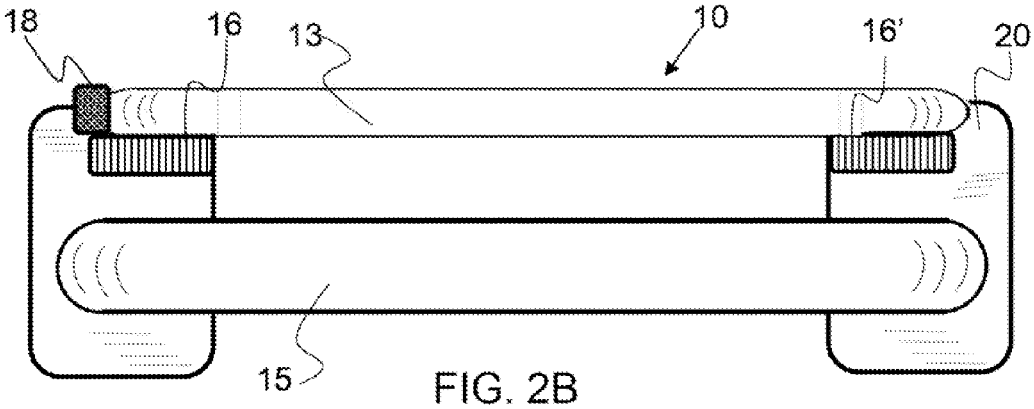

FIG. 2B shows a front view of the exemplary towel rack shown in FIG. 2A having a towel bar and a retainer bar in an open position.

Figure 2C:
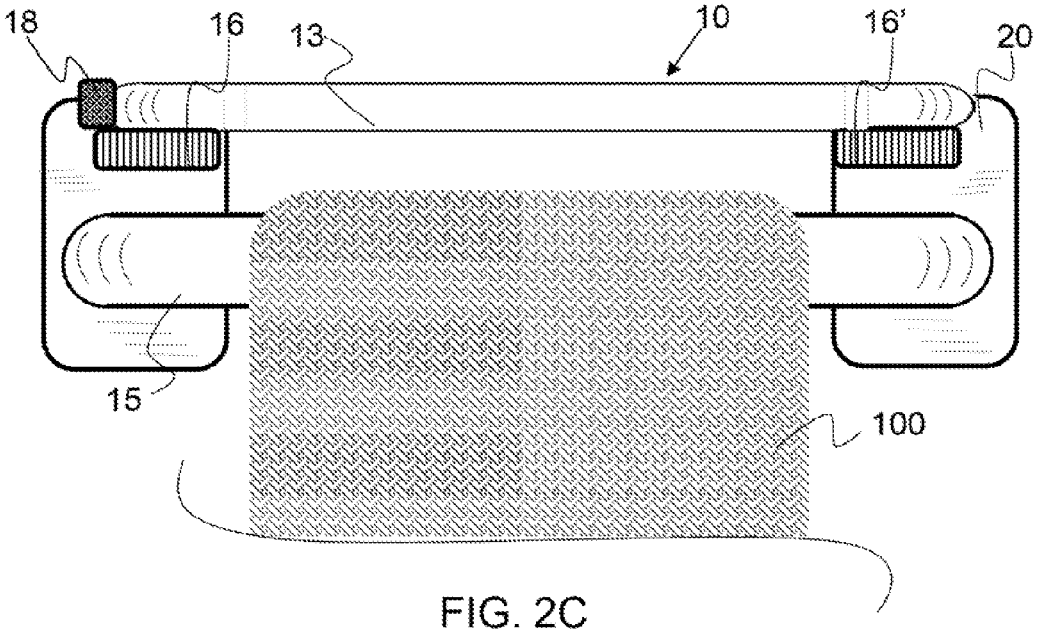

FIG. 2C shows a front view of the exemplary towel rack shown in FIG. 2A having a towel bar and a retainer bar in an open position with a towel draped over the towel bar.

Figure 3A:
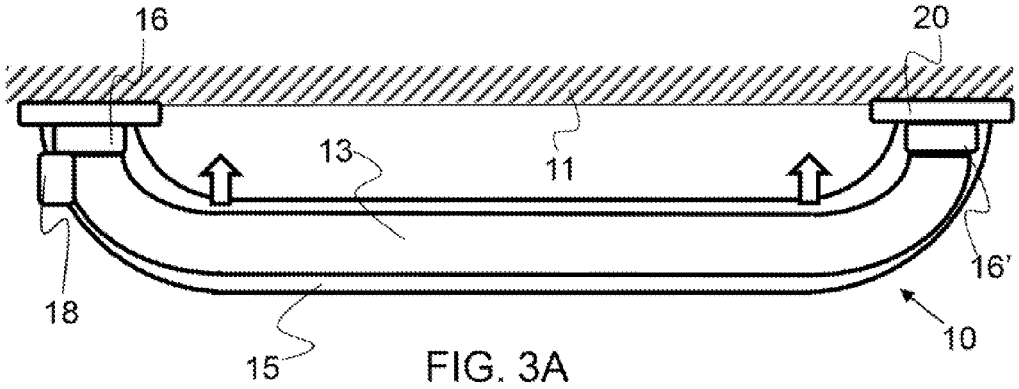

FIG. 3A shows a top down view of an exemplary towel rack having a towel bar and a retainer bar in a dosed position.

Figure 3B:
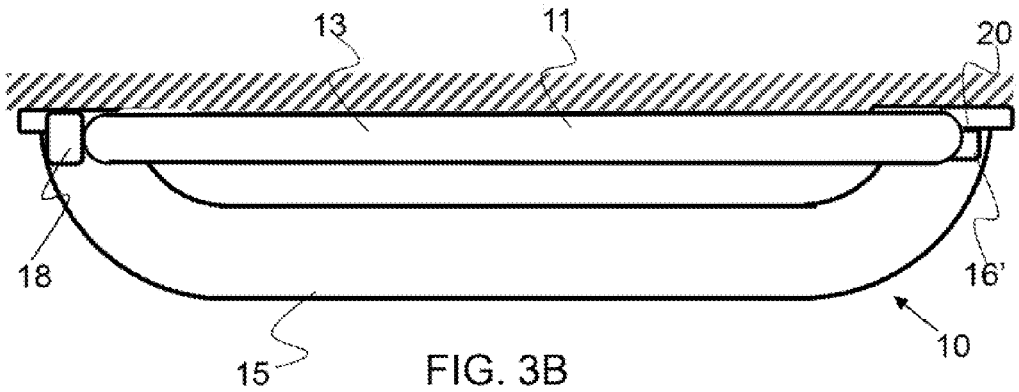

FIG. 3B shows a top down view of the exemplary towel rack shown in FIG. 3A having a towel bar and a retainer bar in an open position.

Figure 3C:
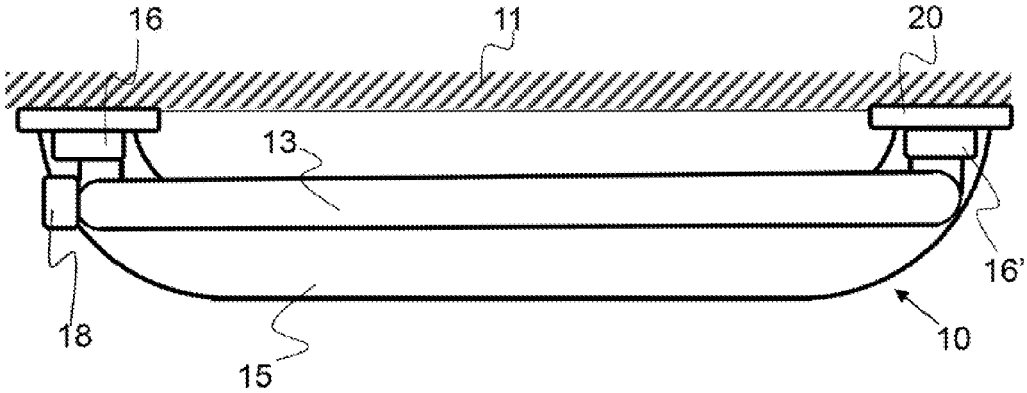

FIG. 3C shows a top down view of the exemplary towel rack shown in FIG. 3A having a towel bar and a retainer bar in an intermediate position between open and closed.

Figure 4A:
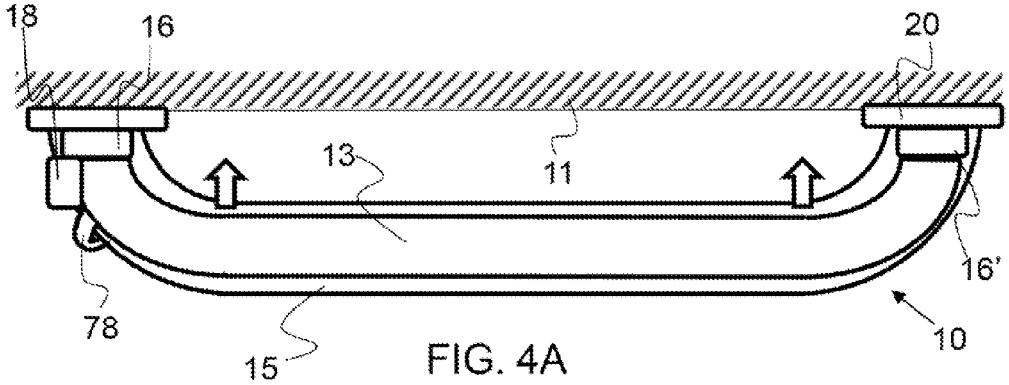

FIG. 4A shows a top down view of an exemplary towel rack having a towel bar and a retainer bar in a dosed position with a hook extending from the retainer bar around the towel bar.

Figure 4B:
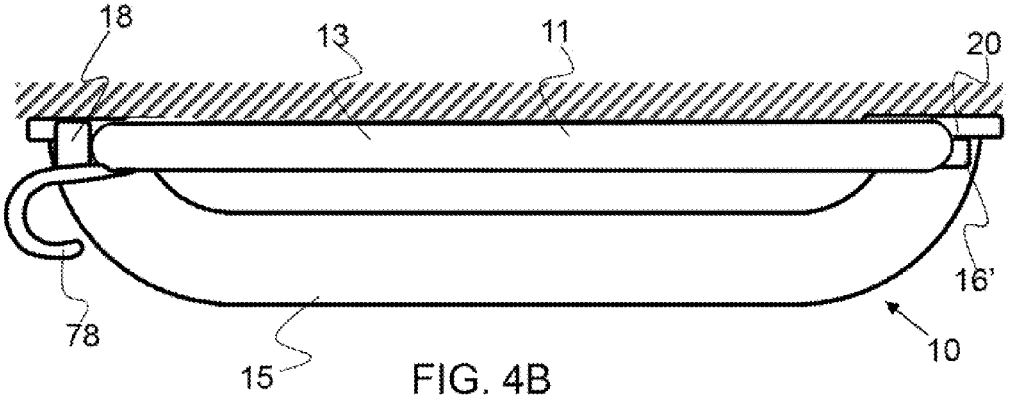

FIG. 4B shows a top down view of the exemplary towel rack shown in FIG. 4A having a towel bar and a retainer bar in an open position.

Figure 4C:
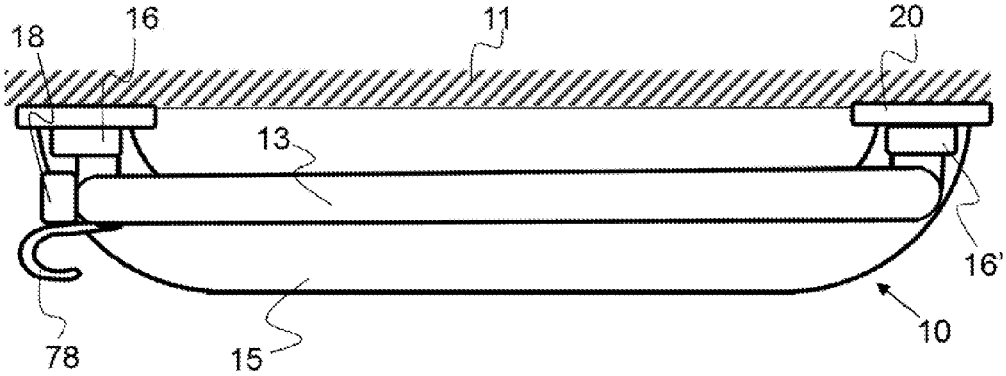

FIG. 4C shows a top down view of the exemplary towel rack shown in FIG. 4A having a towel bar and a retainer bar in an intermediate position between open and closed.

Figure 5A:
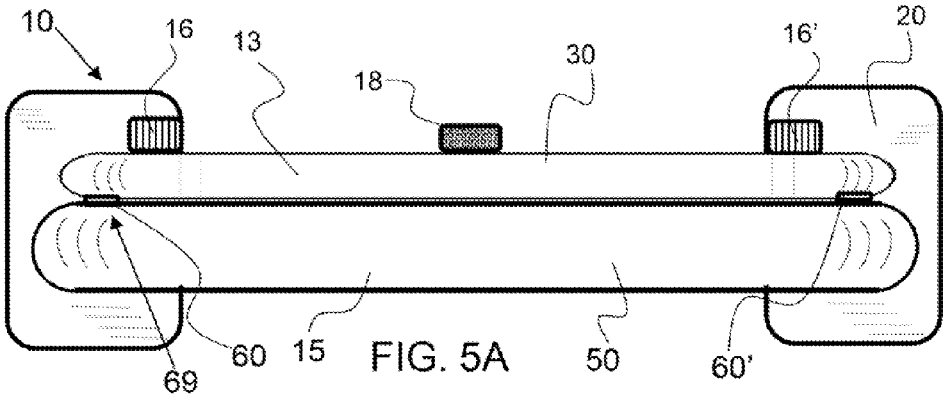

FIG. 5A shows a front view of an exemplary towel rack having a towel bar and a retainer bar in a dosed position with a locking feature retaining the retaining bar in a down position.

Figure 5B:
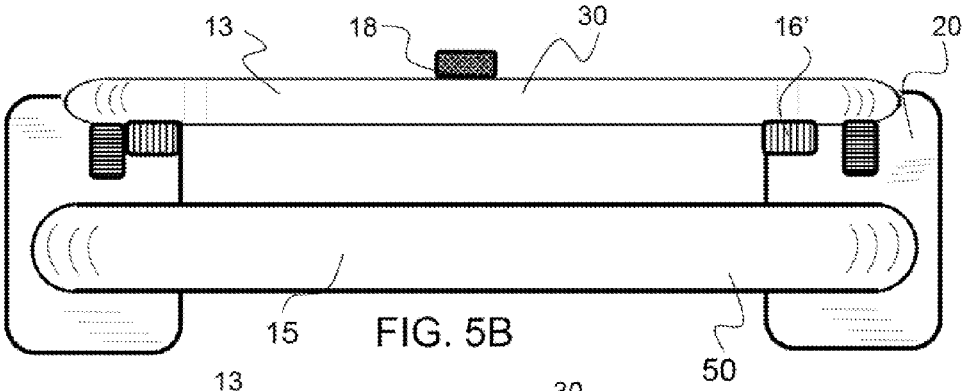

FIG. 5B shows a front view of the exemplary towel rack shown in FIG. 5A having a towel bar and a retainer bar in an open position.

Figure 5C:
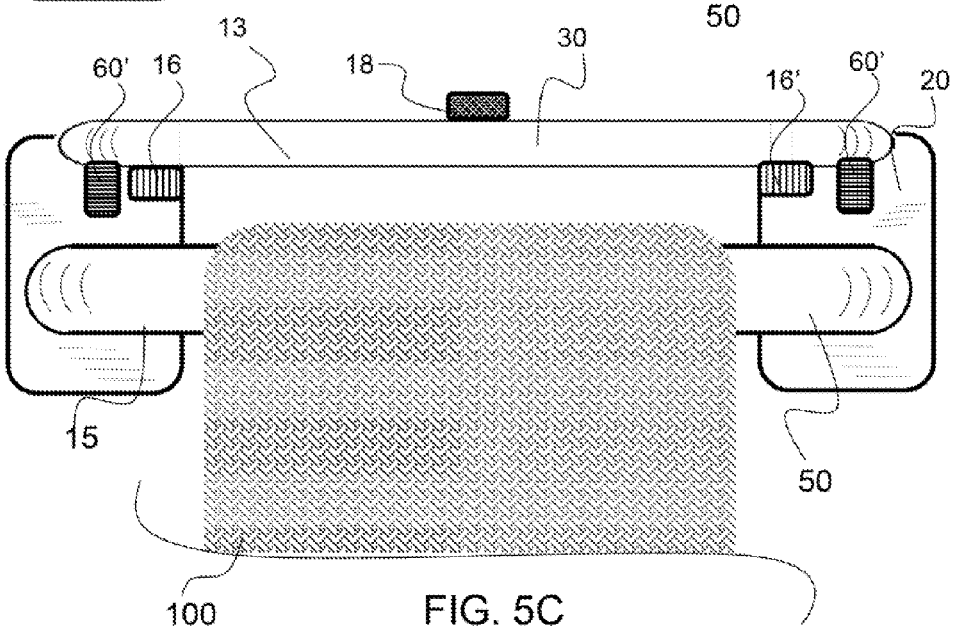

FIG. 5C shows a top down view of the exemplary towel rack shown in FIG. 5A having a towel bar and a retainer bar in an open position with a towel over the towel bar.

Figure 6A:
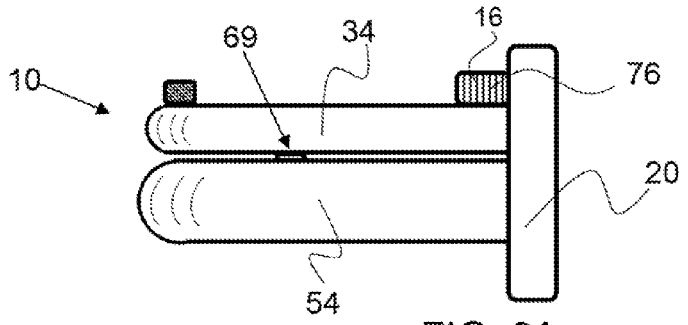

FIG. 6A shows a side view of an exemplary towel rack having a towel bar and a retainer bar in a closed position with a locking feature retaining the retaining bar in a down position.

Figure 6B:
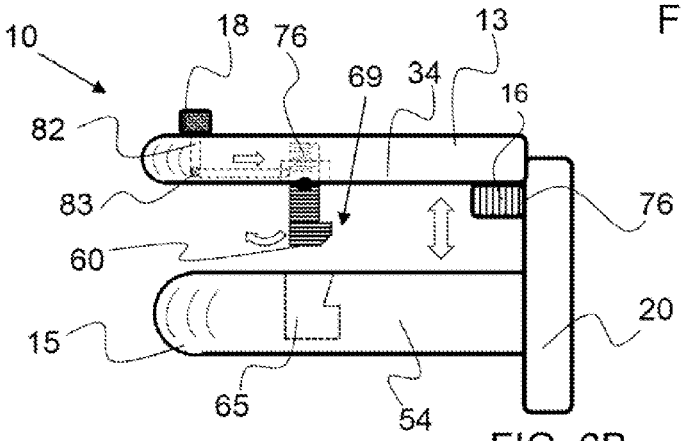

FIG. 6B shows a side view of the exemplary towel rack shown in FIG. 6A having a towel bar and a retainer bar in an open position.

Figure 6C:
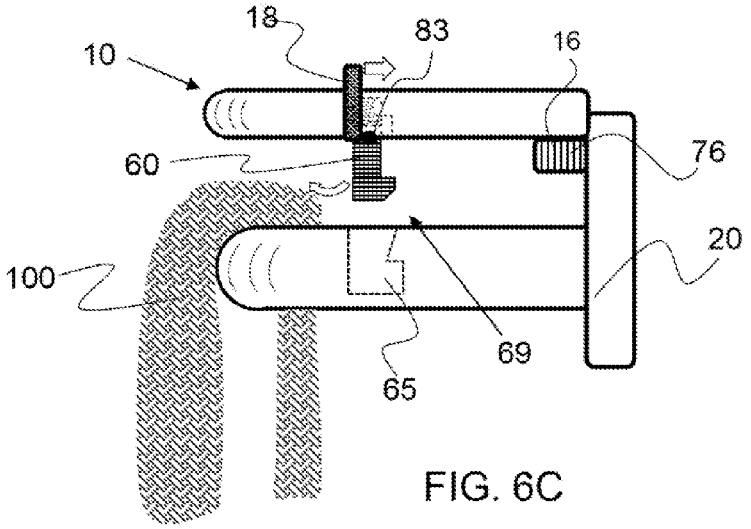

FIG. 6C shows a side view of the exemplary towel rack shown in FIG. 6A having a towel bar and a retainer bar in an open position with a towel over the towel bar.

Figure 7A:
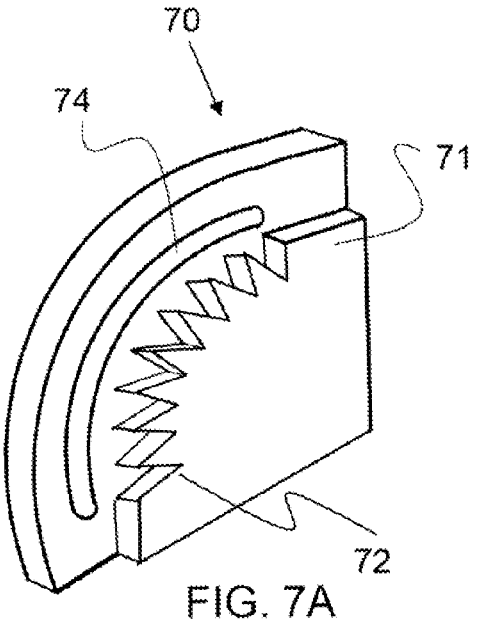

FIG. 7A shows an isometric view of an exemplary engagement bracket having a slot and a plurality of teeth.

Figure 7B:
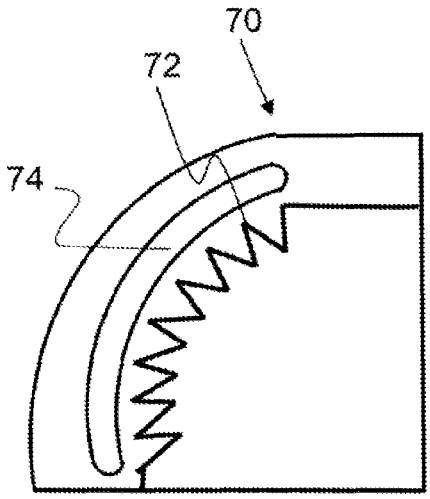

FIG. 7B shows a side view of the exemplary engagement bracket shown in FIG. 7A.

Figure 8:
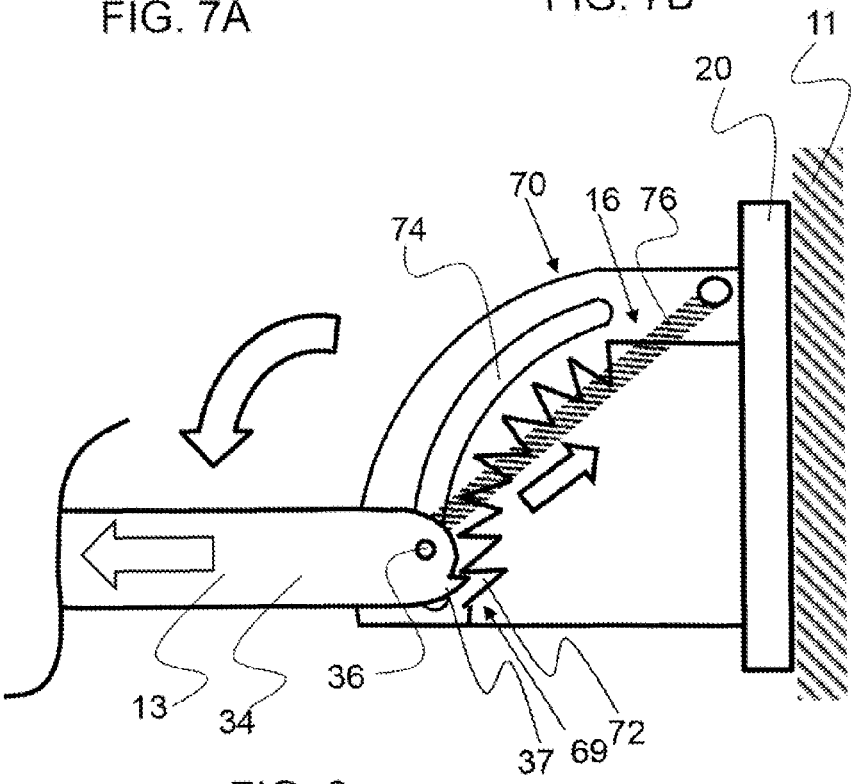

FIG. 8 shows a side view of an exemplary engagement bracket and a retainer bar coupled thereto and in a closed position.

Figure 9:
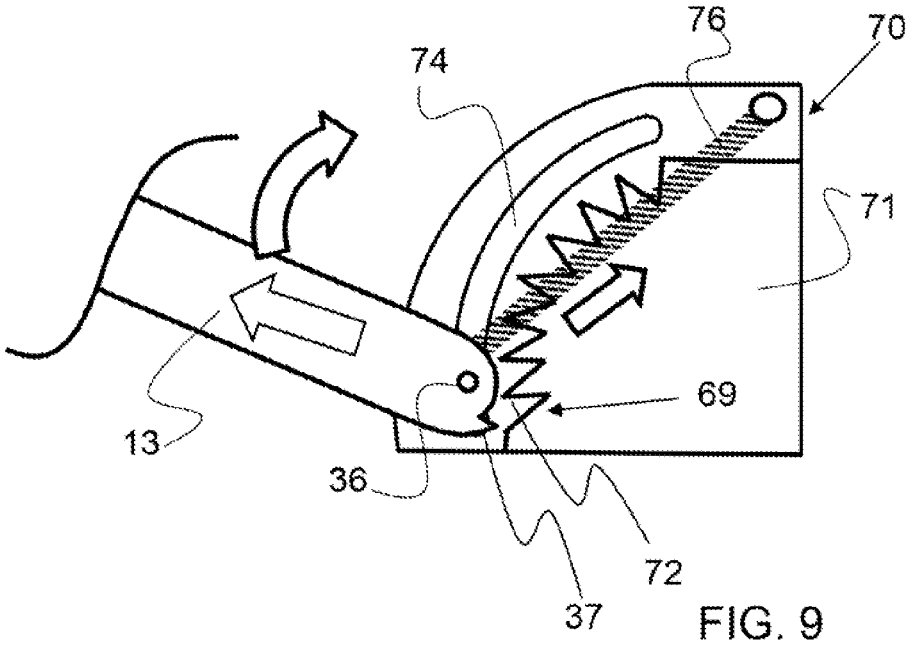

FIG. 9 shows a side view of an exemplary engagement bracket and a retainer bar in a closed position being lifted up to release the engagement feature from being retained by a tooth.

Figure 10:
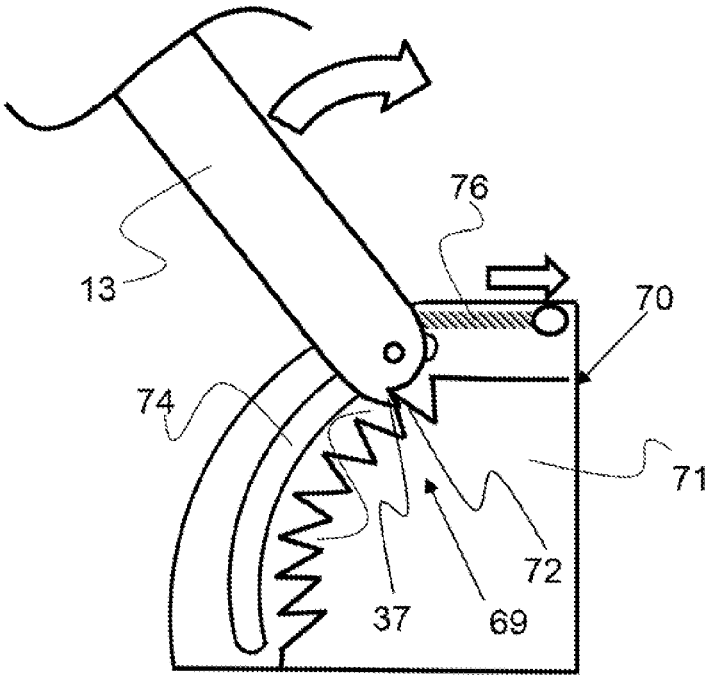

FIG. 10 shows a side view of an exemplary engagement bracket and a retainer bar coupled thereto and in an open position.

Figure 11:
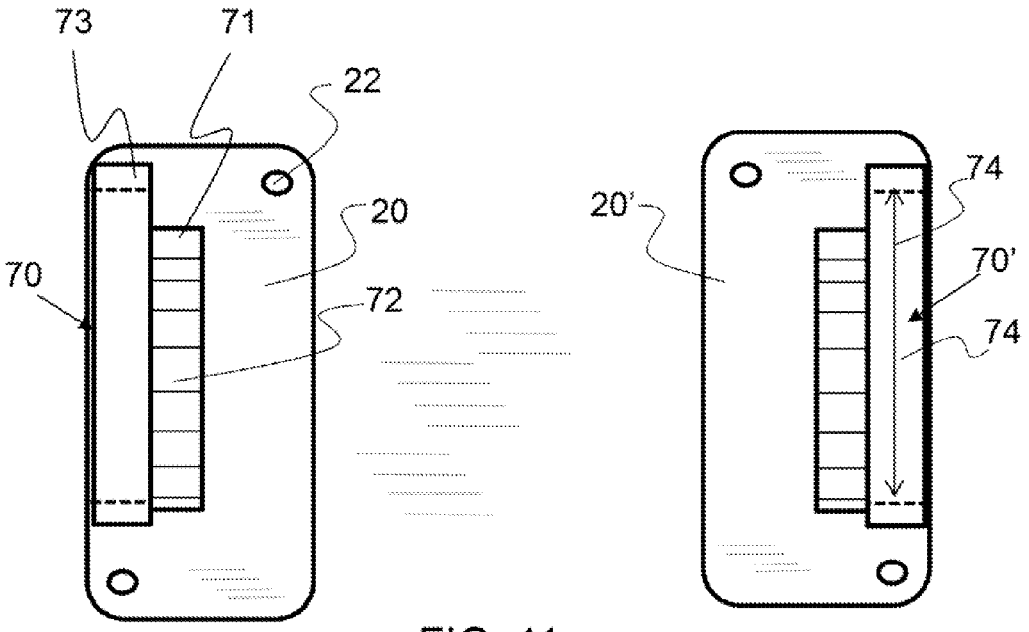

FIG. 11 shows a front view of two exemplary engagement brackets attached to mounting plates.

Figure 12:
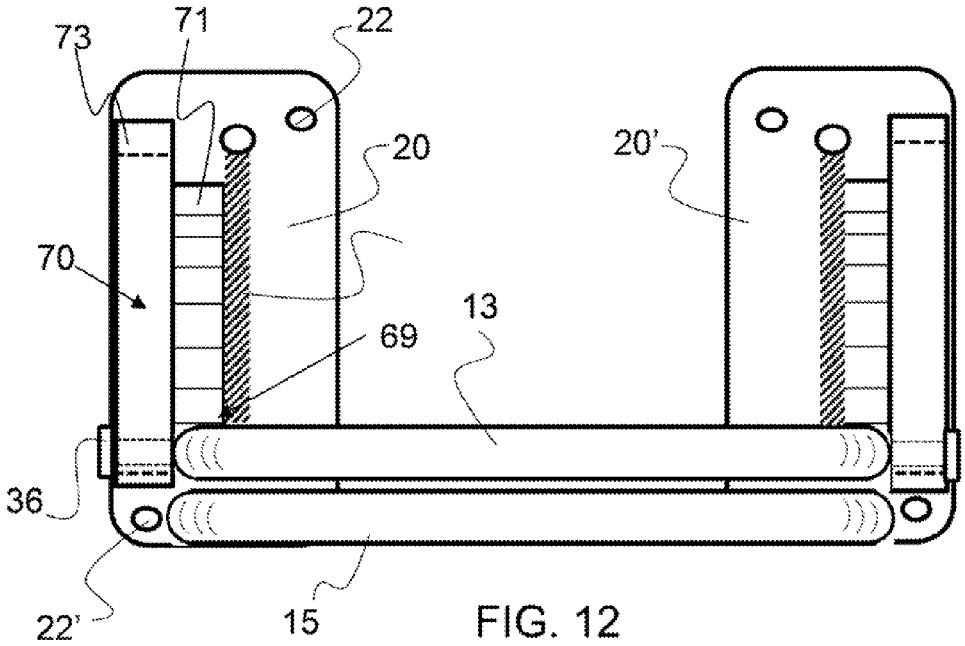

FIG. 12 shows a front view of an exemplary towel rack having a retainer bar coupled between to engagement brackets and in a dosed position.

Figure 13:
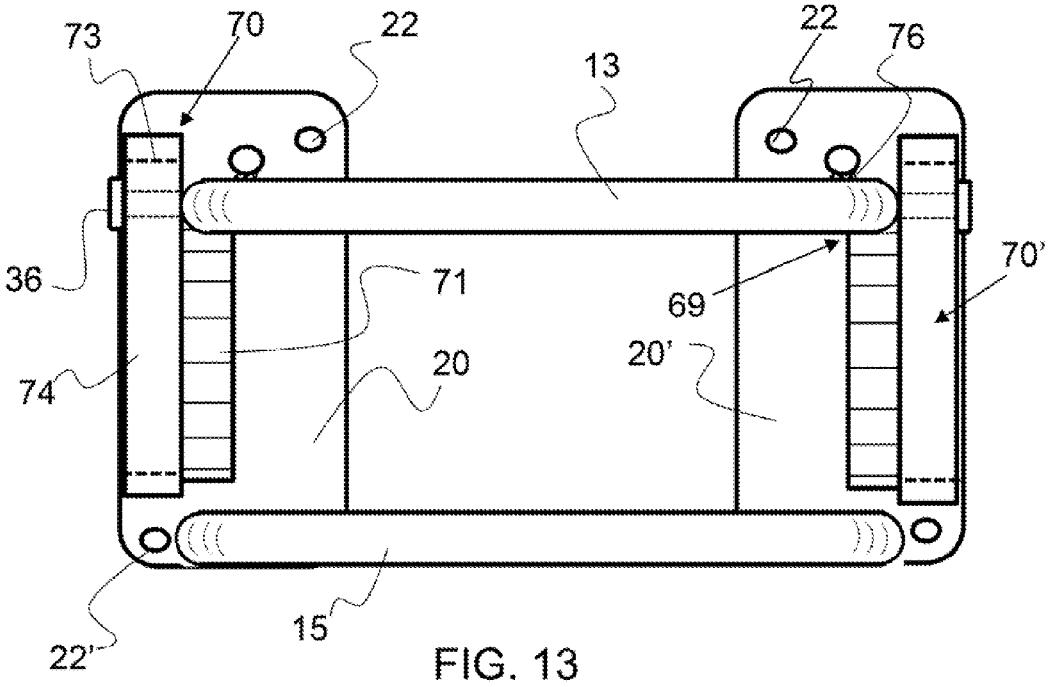

FIG. 13 shows a front view of an exemplary towel rack having a retainer bar coupled between to engagement brackets and in an open position.

Figure 14:
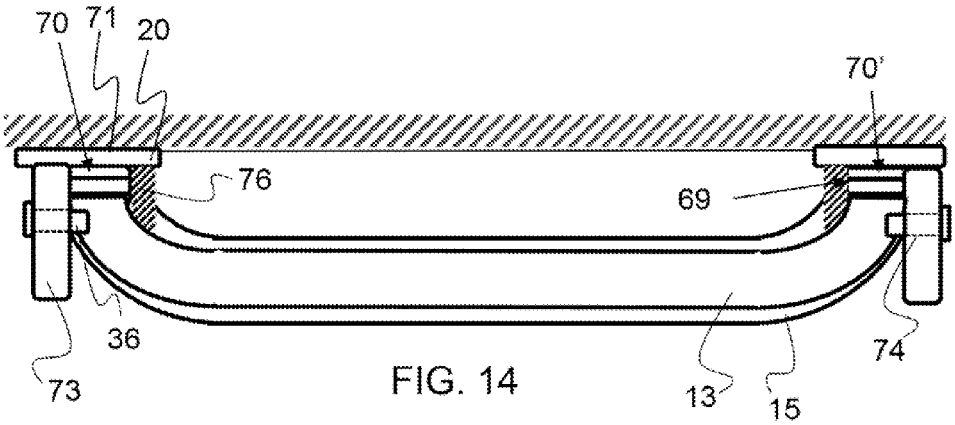

FIG. 14 shows a top down view of an exemplary towel rack having a retainer bar coupled between to engagement brackets and in a dosed position.

Figure 15A:
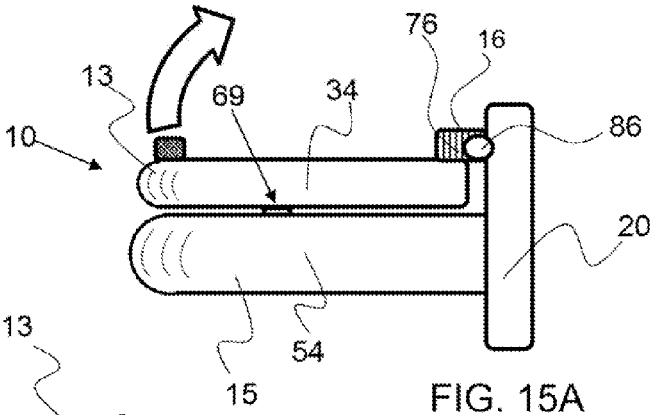
Figure 15B:
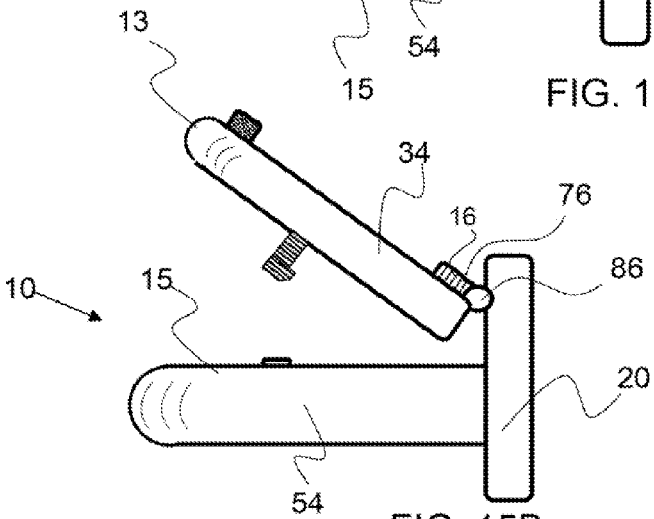

FIGS. 15A and 15B show a side view of an exemplary towel rack having a towel bar and a retainer bar configured to pivot up and away from the towel bar.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary towel rack 10 has a towel bar 15 and a retainer bar 13 in a closed position with the towel bar. The towel bar has an elongated towel portion 50 configured between the first and second bar extensions 52, 54 respectively. Likewise, the retainer bar 13 comprises elongated retainer portion 30 configured between first and second retainer extensions 32, 34 respectively. The towel rack 10 is attached to a mounting surface 11, such as a wall or door, by two mounting plates 20, 20'. A plurality of actuators 16, 16' are configured between the retainer extensions and the mounting plates. 20, 20'. A release device 18, as shown as a button, is configured on one of the actuators 16'. Any number of release devices may be configured on the towel rack as described herein, including, one, two, three or more. The elongated towel and elongated retainer portions are configured at a distance D from the mounting surface 11. As shown in FIG. 1, the elongated retainer portion 30 of the retainer bar 13 extends substantially parallel with the elongated towel portion 50 of the towel bar 15.

As shown in FIG. 2A, an exemplary towel rack 10 has a towel bar 15 and a retainer bar 13 in a closed position. The release device 18 is configured on the retainer bar in this embodiment.

As shown in FIG. 2B, exemplary towel rack 10 shown in FIG. 2A has a towel bar 15 and a retainer bar 13 in an open position.

As shown in FIG. 2C, the exemplary towel rack 10 shown in FIG. 2A has a towel bar 15 and a retainer bar 13 in an open position with a towel 100 draped over the towel bar.

As shown in FIG. 3A an exemplary towel rack 10 has a towel bar 15 and a retainer bar 13 in a closed position. The mounting bracket 20 is attached to the mounting surface 11, as shown in FIG. 3A-3C As shown in FIG. 3B, the exemplary towel rack 10 shown in FIG. 3A has a towel bar and a retainer bar in an open position.

As shown in FIG. 3C, the exemplary towel rack 10 shown in FIG. 3A has a towel bar 15 and a retainer bar 13 in an intermediate position between open and closed.

As shown in FIG. 4A, an exemplary towel rack 10 has a towel bar 15 and a retainer bar 13 in a closed position with a hook 78 extending from the retainer bar around the towel bar.

As shown in FIG. 4B, the exemplary towel rack 10 shown in FIG. 4A has a towel bar 15 and a retainer bar 13 in an open position.

As shown in FIG. 4C, the exemplary towel rack 10 shown in FIG. 4A has a towel bar 15 and a retainer bar 13 in an intermediate position between open and closed.

As shown in FIG. 5A, an exemplary towel rack 10 has a towel bar 15 and a retainer bar 13 in a closed position with a locking feature 69 retaining the retaining bar in a down position.

As shown in FIG. 5B, the exemplary towel rack shown 10 in FIG. 5A has a towel bar 15 and a retainer bar 13 in an open position.

As shown in FIG. 5C, the exemplary towel rack 10 shown in FIG. 5A has a towel bar 15 and a retainer bar 13 in an open position with a towel 100 over the towel bar.

As shown in FIG. 6A, an exemplary towel rack 10 has a towel bar 15 and a retainer bar 13 in a closed position with a latch type locking feature 69 comprising a latch 60 and a latch retainer 65 for retaining the retaining bar in a down position.

As shown in FIG. 6B, the exemplary towel rack 10 shown in FIG. 6A has a towel bar 15 and a retainer bar 13 in an open position having a latch 60 attached thereto. A latch retainer 65 is shown in broken lines in the towel bar 15. The latch 60 is configured to be retained by latch retainer 65 when the retainer bar is pushed down. The latch comprises a geometry configured to lock with a geometric feature of the latch retainer. A spring 76 is coupled to the latch 69, whereby the latch may engage and retain the retainer bar in a closed position with towels or articles of various thickness draped over the towel bar. A spring element may be coupled to the latch and/or the latch retainer to provide a locking feature with a positional range for locking. The release device 18 is coupled to the latch 69 and may comprise any number of pins 83 and rods 82 to actuate the latch in a suitable way to release it from the latch retainer. For example, activating the release device 18, or button as shown, may actuate one or more rods 82, as indicated by the arrow pointing toward the latch that pivots the latch 69 indicated by the arced arrow, to release the latch from the latch retainer. The release device may be coupled directly to the latch, and the user may simple rotate or press the release device to directly rotate or otherwise actuate the latch to release it. The retainer bar as shown in FIG. 6B moves up and down over the towel bar, as indicated by the double arrows, as opposed to rotating up about hinge on a retainer extension as shown in FIGS. 15A and 15B.

As shown in FIG. 6C, the exemplary towel rack 10 has a towel bar 15 and a retainer bar 13 in an open position with a towel 100 over the towel bar. The release device 18 is directly connected with the latch in this embodiment. A user of the towel rack 10 would simply have to push the release device as indicated by the arrow to rotate the latch and release it.

As shown in FIGS. 7A and 7B, an exemplary engagement bracket 70 has a slot 74 and a plurality of teeth 72.

As shown in FIG. 8, an exemplary engagement bracket 70 has a retainer bar 13 coupled thereto and in a dosed position. A post 36 extends from the retainer extension 34 into the slot 74 to couple the retainer bar to the engagement bracket. The slot may be oversized to allow movement of the retainer bar along the slot and some motion back and forth within the slot. The locking feature 69 shown in FIG. 8 comprises a tooth 72 and an engagement feature 37 or extended portion from the retainer bar 13 configured to couple with a tooth. The engagement feature 37 locks the retainer bar in a position along the slot and the weight of the bar keeps the retainer bar engaged with the towel bar or with an article draped there over. A spring 76 is configured from the engagement bracket to the retainer bar 13. A spring, configured to pull the retainer bar up along the slot, may be configured in any suitable location with attachments to a mounting plate instead of the engagement bracket, for example. The opposing end of the spring may be coupled to the retainer bar in any suitable location including a retainer extension as shown, or to the elongated retainer portion. A user would simply have to pull the retainer bar forward, or away from the mounting surface, as indicated by the arrow along the retainer bar, to release the engagement feature from the tooth 72. The retainer bar would then be pulled up by the spring and whereby the user could release the bar to have it engaged in a second tooth, whereby the retainer bar would be in an open or intermediate position. This type of locking feature 69 comprises no specific release device, such as a button or lever as shown in previous embodiments. Manipulation of the retainer bar is part of the release device in this embodiment.

As shown in FIG. 9, a retainer bar 13 is in a closed position and is being lifted up, as indicated by the arced arrow, to release the engagement feature 37 from being retained by a tooth 72. Pivoting the retainer bar up and pulling it out, or away from the mounting surface, as indicated by the arrow along the retainer bar, releases the retainer bar from the locking feature 69 and the spring 76 then assists the retainer bar to move up along the slot 74.

As shown in FIG. 10, a retainer bar 13 is coupled to an exemplary engagement bracket 70 in an open position. The spring 76 is retracted.

As shown in FIG. 11, two exemplary engagement brackets 70, 70' are attached to mounting plates 20, 20'. The engagement brackets comprise a locking portion 71 comprising the plurality of teeth 72 and a slide portion 73 comprising the slot 74. The locking portion is configured on the inside of the engagement bracket, whereby the two locking portions face each other. The slide portions of the engagement brackets are configured on the outside. It is to be understood that this configuration could be reversed however and the retainer bar could be configured to extend inside or to the outside of the engagement brackets.

As shown in FIG. 12, an exemplary towel rack 10 has a retainer bar 13 coupled between to engagement brackets 70, 70' in a closed position.

As shown in FIG. 13, an exemplary towel rack 10 has a retainer bar 13 coupled between to engagement brackets 70, 70' in an open position.

As shown in FIG. 14, an exemplary towel rack 10 has a retainer bar coupled between to engagement brackets and in a dosed position. As shown in FIG. 14, the post 36 extends through the slot in the slide portion 73 of the engagement bracket 70.

As shown in FIGS. 15A and 15B . . . an exemplary towel rack 10 has a towel bar 15 and a retainer bar 13 in a closed position. The retainer bar 13 is configured to pivot up and away from the towel bar, as indicated by the arced arrow in FIG. 15A, about a pivot 86. The pivot may be couple to the actuator 16, or may be coupled to the retainer bar, such as coupled directly to a retainer extension 34 whereby the actuator is coupled to the retainer bar to pivot the retainer bar about the pivot.

DEFINITIONS

Closed position, as used herein, means that the retainer bar is in a down an engaged position with the towel bar or with a towel or other article draped thereon.

Open position, as used herein, means that the retainer bar is in an up position, whereby a towel or other article draped on the towel bar can be removed.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents

What is claimed is:

1. An actuating towel rack comprising:

a. a towel bar comprising:

i. an elongated towel portion; and ii. first and second bar extensions;

wherein said elongated towel portion is coupled with said first and second bar extensions to retain said elongated towel portion at a distance from a mounting surface and wherein said elongated towel portion is configured to extend substantial parallel with said mounting surface;

b. a retainer bar comprising:

i. elongated retainer portion; and ii. first and second retainer extensions;

wherein said elongated retainer portion is coupled with said first and second retainer extensions to retain the elongated retainer portion at a distance from a mounting surface, and wherein said elongated retainer portion is configured to extend substantial parallel with said mounting surface and substantially parallel with and over said elongated towel portion of said towel bar;

c. an actuator;

wherein the retainer bar is configured to actuate down from an open position to a closed position over the towel bar for the purpose of retaining a towel draped over the towel bar, wherein the actuator is spring loaded to actuate the retainer bar from said closed position to said open position;

d. an engagement bracket that extends out from the mounting surface comprising:

i. a slot extending through the engagement bracket;

wherein the slot extends up and toward the mounting surface in a substantially arc shape;

ii. a plurality of teeth configured substantially along the slot;

iii. a spring configured to pull the retainer bar up along the slot, wherein the retainer bar comprises an engagement feature configured to lock into a locked position with one of said plurality of teeth on the engagement bracket to retain the retainer bar in a position;

wherein the retainer bar comprises a post that extends into said slot and whereby the retainer bar is actuated by a spring coupled to the retainer bar when the engagement feature is released from said locked position such that the retainer bar moves along the slot;

whereby the retainer bar is configured to be retained in a closed position with the retainer bar resting over the towel bar with the engagement feature retained in one of said plurality of teeth of the engagement bracket and the spring in an extended state;

whereby the retainer bar is configured to be retained in an up position with the retainer bar configured up and away from the towel bar with the engagement feature retained in one of said plurality of teeth of the engagement bracket and the spring in a retracted state;

wherein the elongated retainer portion remains substantially parallel with the elongated towel portion in an open position; and wherein when the retainer bar is in an open position, the elongated towel portion is exposed for placement of a towel there over.

2. The actuating towel rack of claim 1, further comprising:

a. at latch; and b. a latch retainer, wherein the latch extends from the retainer bar and the latch retainer is located on the towel bar.

3. The actuating towel rack of claim 2, comprises a hook that is configured to retain the retainer bar in the closed position.

4. The actuating towel rack of claim 1, further comprising a release device, wherein the release device is coupled with a locking feature and activation of the release device when the retainer bar is in a closed position releases the locking feature, whereby the actuator thereafter moves the retainer bar from a closed position to an open position.

5. The actuating towel rack of claim 4, wherein the release device is configured on the retainer bar.

* * * * *